US009127518B1

(12) United States Patent
Sewell

(10) Patent No.: US 9,127,518 B1
(45) Date of Patent: Sep. 8, 2015

(54) VARIABLE ANGLE DRILLING MACHINE

(75) Inventor: Cody L. Sewell, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 586 days.

(21) Appl. No.: 13/560,291

(22) Filed: Jul. 27, 2012

Related U.S. Application Data

(60) Provisional application No. 61/515,026, filed on Aug. 4, 2011.

(51) Int. Cl.
*E21B 7/02* (2006.01)
*E21B 19/20* (2006.01)
*E21B 19/15* (2006.01)

(52) U.S. Cl.
CPC . *E21B 19/20* (2013.01); *E21B 7/02* (2013.01); *E21B 19/15* (2013.01)

(58) Field of Classification Search
CPC ..... E21B 19/14; E21B 19/146; E21B 19/15; E21B 19/155; E21B 19/20; E21B 7/02
USPC ..... 414/22.51–22.53, 22.62, 745.1, 745.5, 414/745.6, 745.9
See application file for complete search history.

(56) References Cited

U.S. PATENT DOCUMENTS

2011/0174545 A1* 7/2011 Hartke et al. ..... 175/113

* cited by examiner

*Primary Examiner* — Robert E Fuller
*Assistant Examiner* — Steven MacDonald
(74) *Attorney, Agent, or Firm* — Tomlinson Rust McKinstry Grable

(57) ABSTRACT

A variable angle drilling machine comprises a frame and a pipe handling system. The pipe handling system is capable of moving from a horizontal to a second orientation and comprises a magazine, a carriage assembly, a shuttle assembly, and a pipe section biasing assembly. The pipe section biasing assembly biases pipe sections towards an open side of the magazine in order for the shuttle assembly to grab a pipe section from the magazine and transport the pipe section to the carriage assembly. The carriage assembly makes up or breaks up a drill string during variable angle boring operations.

27 Claims, 6 Drawing Sheets

VARIABLE ANGLE DRILLING MACHINE

CROSS REFERENCE TO RELATED APPLICATION

This application claims the benefit of provisional patent application Ser. No. 61/515,026 filed on Aug. 4, 2011, the entire contents of which are incorporated herein by reference.

FIELD OF THE INVENTION

The present invention relates generally to the field of variable angle drilling, and in particular to automated pipe handling systems for variable angle drilling machines.

SUMMARY OF THE INVENTION

The present invention, is directed to a drilling machine. The drilling machine comprises a frame and a pipe handling system. The pipe handling system comprises a magazine, a carriage assembly, a shuttle assembly, and a pipe section biasing assembly. The magazine is capable of moving between a horizontal position and a second orientation greater than 30 degrees relative to a horizontal plane. The magazine stores a plurality of pipe sections and comprises an open side. The carriage assembly is used for connecting the pipe sections to a drill string. The shuttle assembly is supported on the frame and transports the pipe sections from the magazine to the carriage assembly. The pipe section biasing assembly is used for biasing the pipe sections towards the open side and adjusts a biasing force on the pipe sections within the magazine as the pipe sections are removed from and added to the magazine at the open side.

The present invention is also directed to a pipe handling system for use with a drilling machine. The pipe handling system comprises a magazine, a carriage assembly, a shuttle assembly, and a pipe section biasing assembly. The magazine is moveable between a horizontal position and a second orientation greater than 30 degrees relative to a horizontal plane and stores a plurality of pipe sections and comprises an open side. The carriage assembly is used for connecting the pipe sections to a drill string. The shuttle assembly transports the pipe sections from the magazine to the carriage assembly. The pipe section biasing assembly biases pipe sections within the magazine towards the shuttle assembly and adjusts a biasing force on the pipe sections within the magazine as the pipe sections are removed from and added to the magazine. The pipe section biasing assembly is on a side of the magazine opposite the open side.

The present invention is also directed to a method for drilling into the ground. The method comprises the steps of positioning a drilling machine at a desired location, pivoting a magazine containing a plurality of pipe sections from a substantially horizontal position to a second, orientation greater than 30 degrees relative to a horizontal plane, and biasing the plurality of pipe sections towards a shuttle assembly using a pipe section biasing assembly. The method further comprises the steps of grabbing the pipe section from an open side of the magazine using the shuttle assembly, advancing the pipe section to a carriage assembly using the shuttle assembly, and connecting the pipe section to a drill string using the carriage assembly.

The present invention additionally is directed to a method for removing a drill string from the ground. The method comprises the steps of disconnecting a pipe section of the drill string from the drill string using a carriage assembly, transporting the pipe section from the carriage assembly to a magazine using the shuttle assembly, decreasing the tension exerted by a pipe biasing assembly attached to the magazine in order to allow the pipe section to be inserted within an open column of the magazine, and using the shuttle assembly to insert the pipe section into the column within the magazine.

DESCRIPTION OF THE PREFERRED EMBODIMENT

Horizontal directional drills are typically used to remove and install utilities horizontally underground with minimal surface disruption. Variable angle drilling machines are very similar to horizontal directional drills, but are instead used to drill at a plurality of different angles underground with minimal surface disruption. Variable angle drilling machines of this nature are typically used to install geothermal heating and cooling systems.

Figure 1:
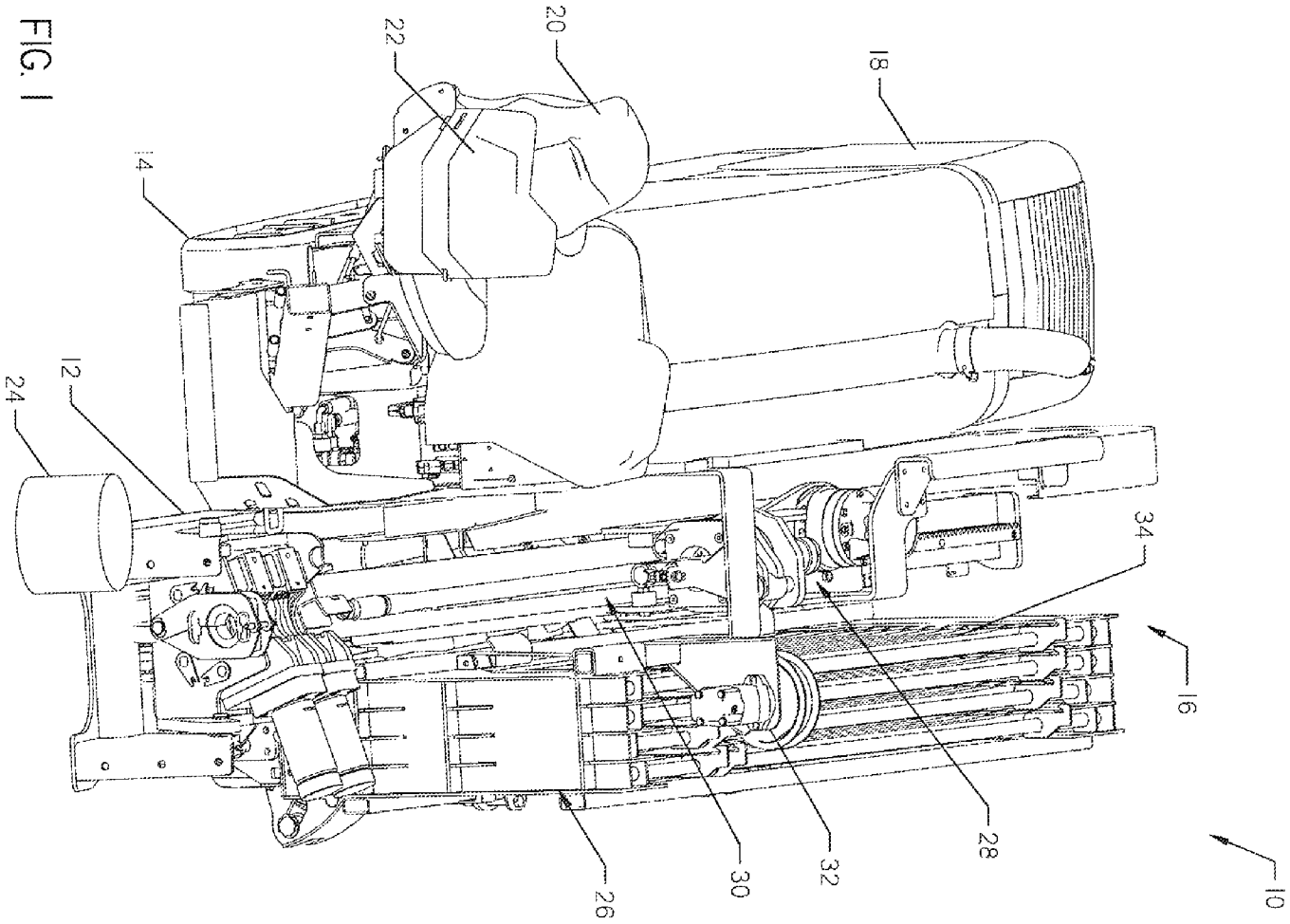
FIG. 1 is a perspective view of a boring machine with a pipe handling system of the present invention.

Turning now to the drawings in general and FIG. 1 specifically, shown therein is a variable angle drilling machine in accordance with the present invention. The drilling machine designated generally by reference numeral 10, generally comprises a frame 12, a motive means 14, a pipe handling system 16, a power unit 18, and, an operator station 20. The variable angle drilling machine 10 is operated and monitored with controls 22 located at the operator station 20. The motive means 14 work to transport the machine 10 to a desired location while an anchor guide 24 guides an earth anchor (not shown) used to secure the machine 10 during operation.

Figure 4:
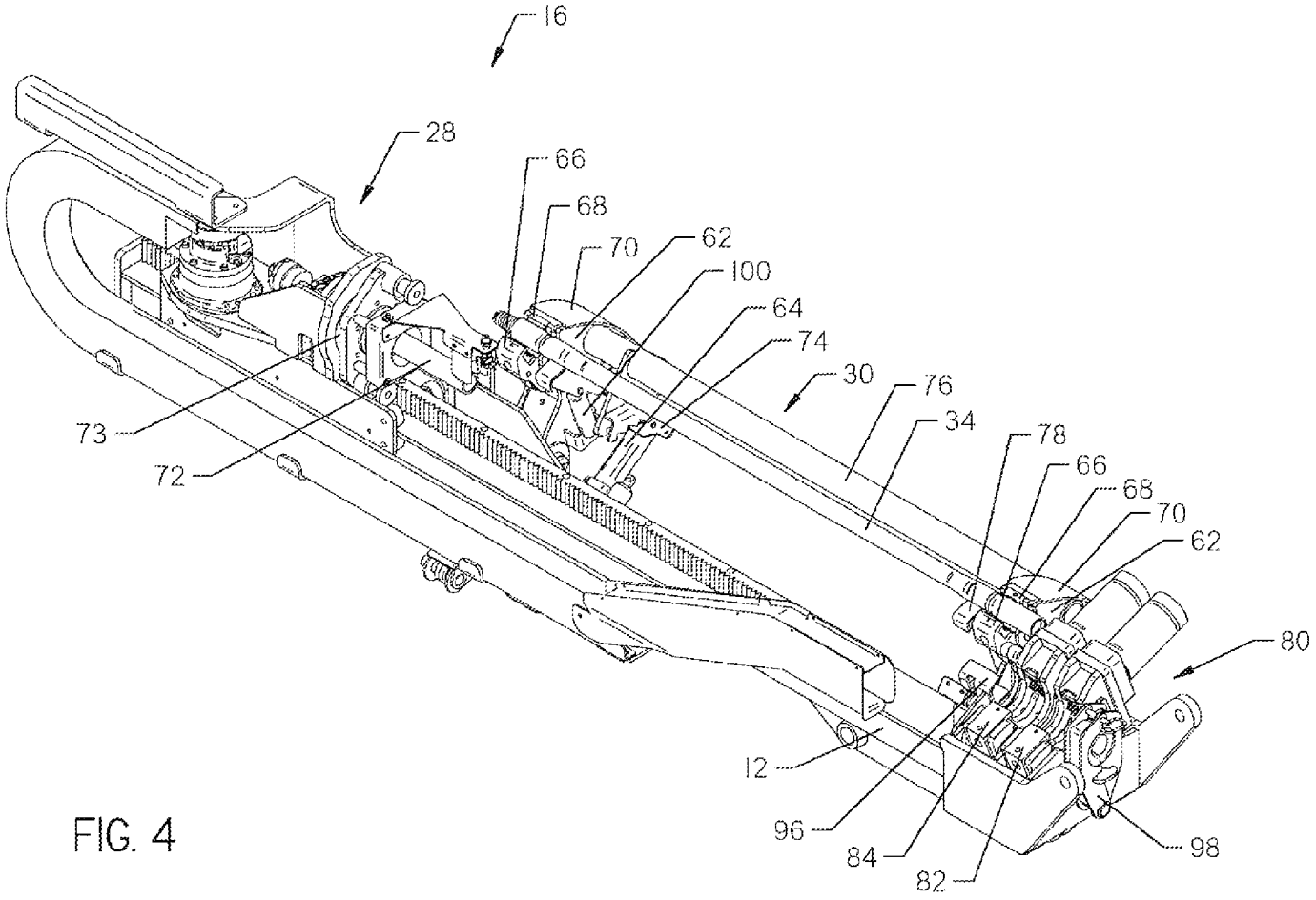
FIG. 4 is a perspective view of the carriage portion of the drilling machine.
Figure 5:
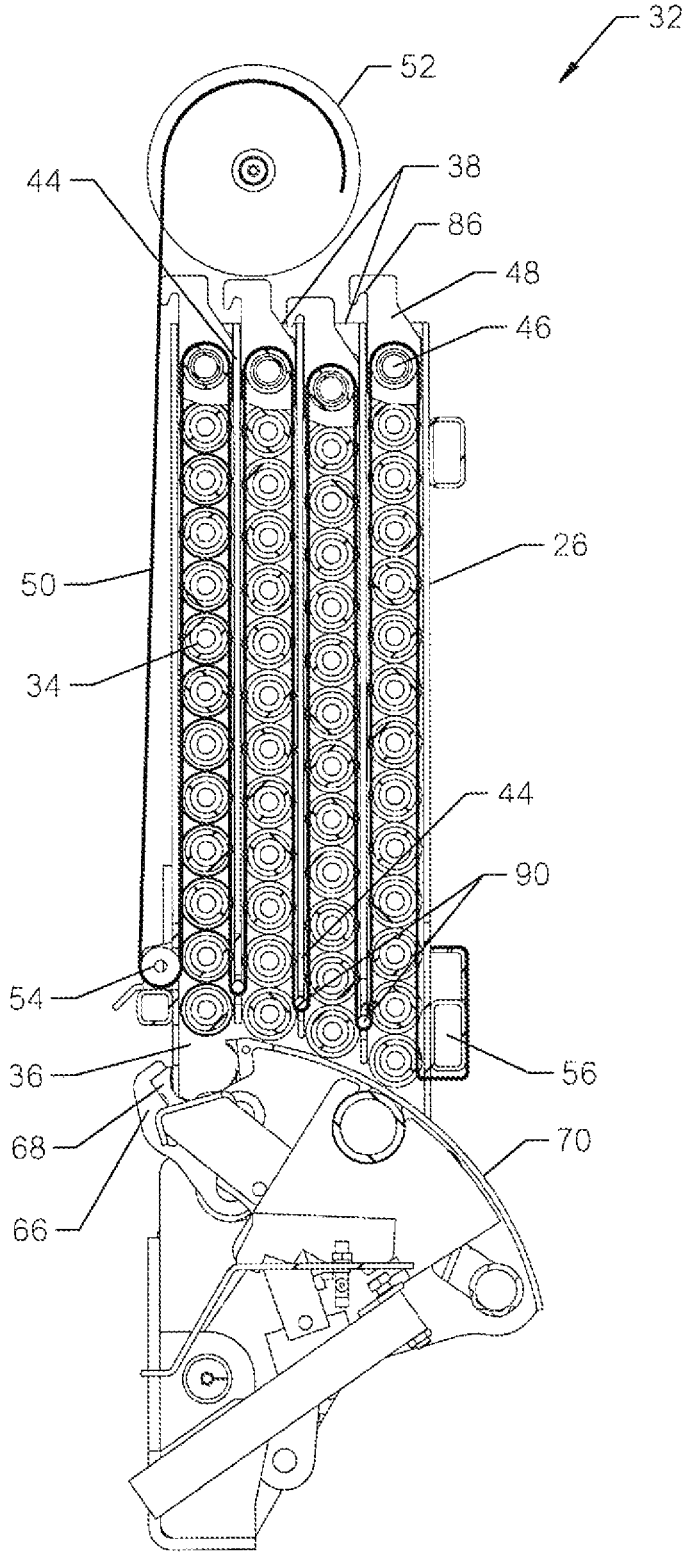
FIG. 5 is a cross-sectional view of the pipe magazine portion of the pipe handling system.

The pipe handling system 16 comprises a magazine 26, a carriage assembly 28, a shuttle assembly 30, and a pipe section biasing assembly 32 (FIG. 4). The magazine 26 stores a plurality of pipe sections 34 and comprises an open side 36 (FIG. 5). The pipe handling system 16 is capable of moving between a horizontal position and a second orientation. The second orientation may be any desired angular orientation between the horizontal and vertical position. Preferably, the variable angle drilling machine will operate at any angle between 30 degrees and 90 degrees relative to a horizontal plane. The pipe section biasing assembly 32 serves to bias the pipe sections 34 within the magazine 26 towards the open side 36 of the magazine 26. The pipe section biasing assembly 32 adjusts a biasing force on the pipe sections 34 within the magazine 26 as the pipe sections 34 are removed from and added to the magazine 26 at the open side 36 (FIG. 5). The shuttle assembly 30 is supported on the frame 12 and transports the pipe sections 34 from the magazine 26 to the carriage assembly 28. The carriage assembly 28 connects the pipe sections 34 together to form a drill string.

Figure 2:
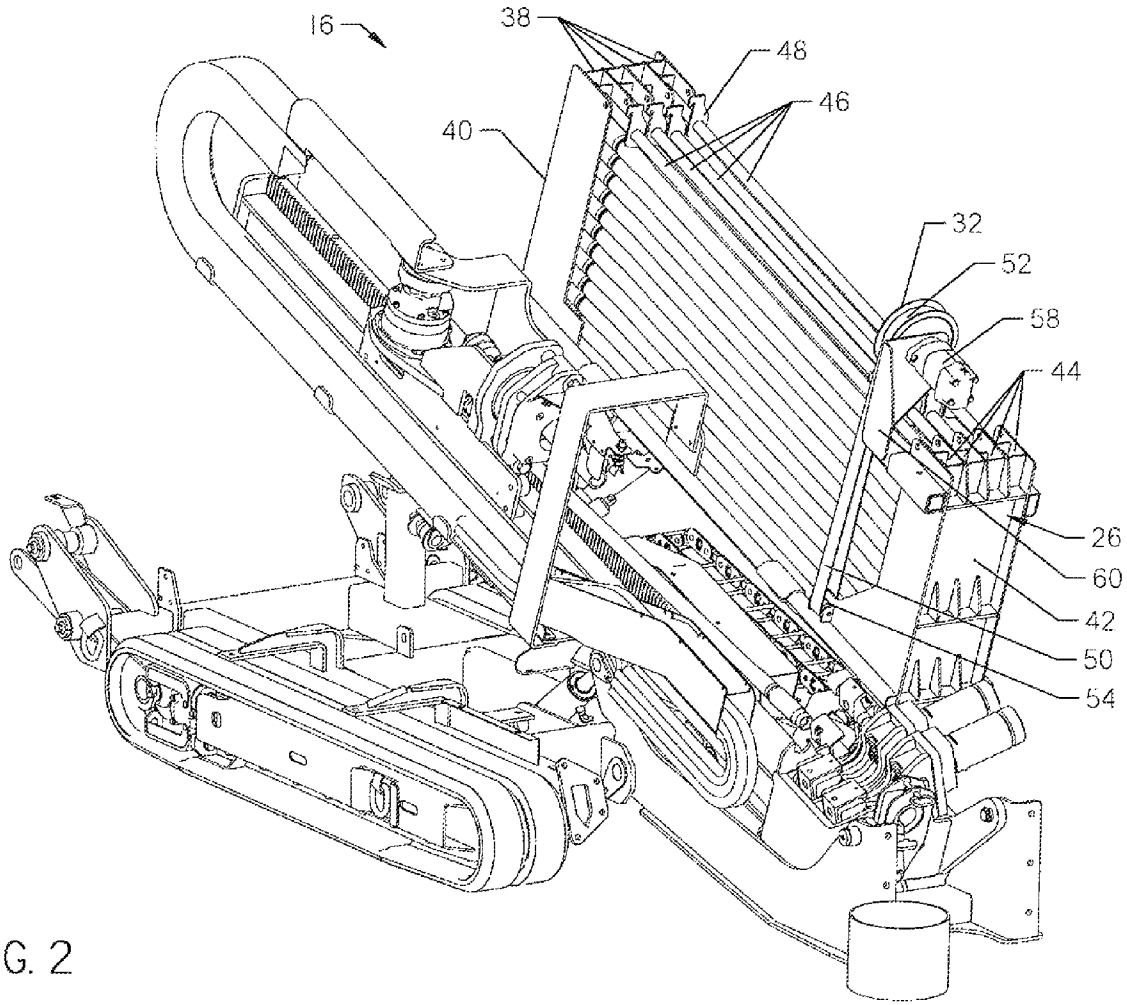
FIG. 2 is a perspective view of the pipe handling system supported on a movable frame.
Figure 3:
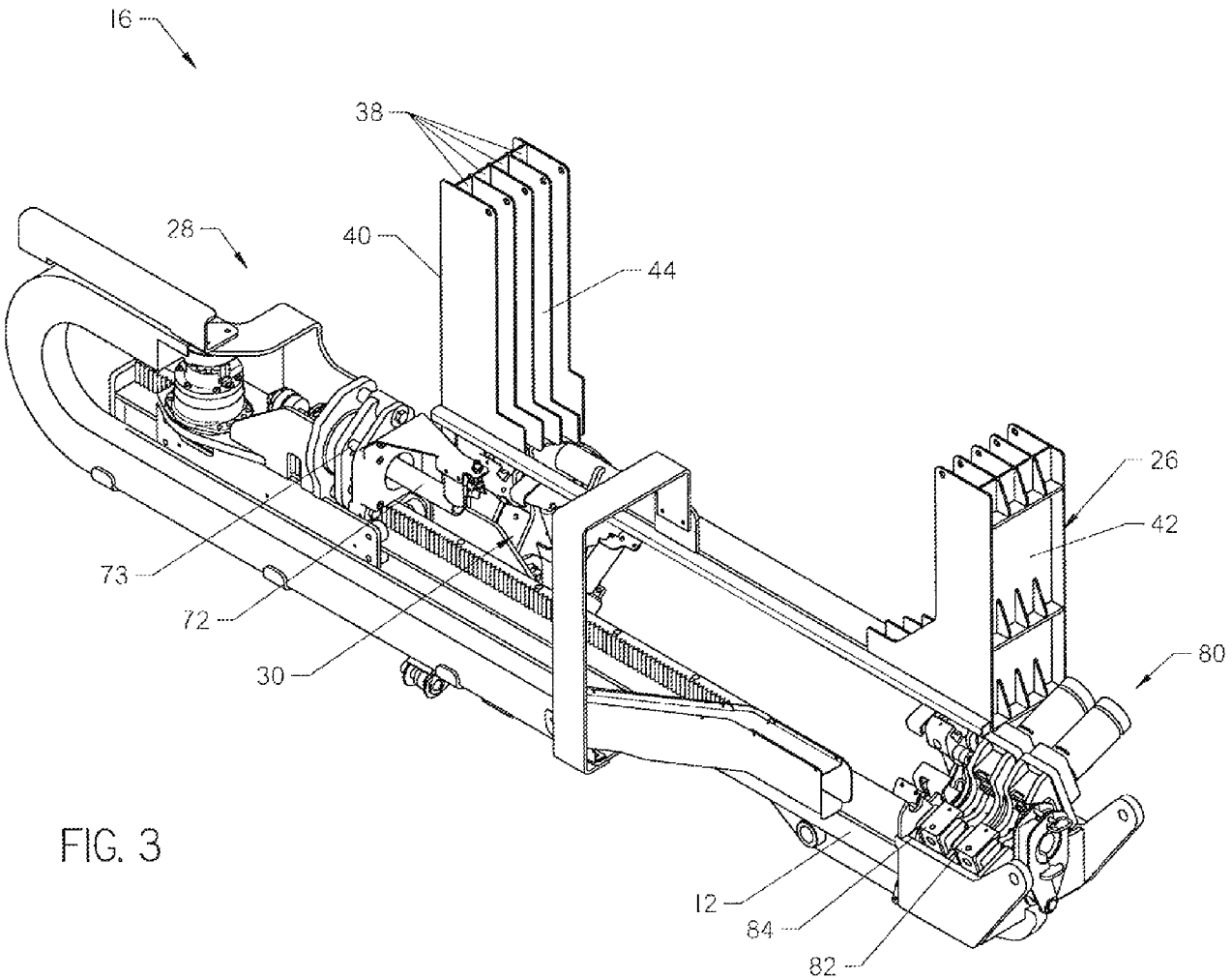
FIG. 3 is a perspective view of the pipe handling system of FIGS. 1 and 2 with the pipe sections removed.

Turning now to FIGS. 2 and 3, the pipe handling system 16 of the present invention is shown in greater detail. The magazine 26 has a plurality of pipe receiving columns 38. The pipe sections 34 are removed from the magazine 26 in FIG. 3 in order to depict the columns 38 more clearly. The columns 38 are formed by a pair of opposing ends 40 and 42 and a plurality of dividers 44. The dividers 44 correspond to create the columns 38 for receiving the pipe sections 34. The number of columns 38 is dependent on the number of dividers 44 formed in the opposing ends 40 and 42.

The magazine 26 also comprises a plurality of stop members 46 placed between the divider 44 (FIG. 2). The stop members 46 function to maintain the pipe sections 34 within the magazine 26 and help push individual pipe sections 34 out of the magazine in a yet to be described process. Each stop tube 46 comprises a stop plate 48 disposed on at least one end of the stop tube to prevent the stop tube from exiting out of magazine 26 after the column 38 of pipe sections 34 has been completely discharged. The stop tube 46 is also adapted to engage the pipe section biasing assembly 32 to move pipe sections 34 from the magazine 26.

The pipe section biasing assembly 32 may comprise a band 50 interwoven between each column 38 (FIG. 5). However other configurations of a pipe biasing assembly may be used, such as springs, pistons or the like. FIGS. 2 and 5 shows a spool 52 is disposed on the magazine 26 proximate the end piece 42. The band 50 is wound around the spool 52, over the stop members 46, and between the columns of pipe sections 34. The band 50 extends from the spool 52 down the magazine 26 to a roller 54 attached to the end piece 42. The band 50 passes around the roller 54 and interweaves between the columns 38 of pipe sections 34. The terminal end of the band is fastened to a bracket 56. The band 50 is held in tension by hydraulic motor 58. The hydraulic motor 58 is mounted to the magazine 26 using a motor mount 60. Tension on the band 50 exerts force on the stop members 46 and pipe sections 34 allowing the band to control the organized movement of the pipe sections within and in and out of the magazine 26.

Referring now to FIGS. 3 and 4, the shuttle assembly 30 is shown disposed proximate the magazine 26 and adapted to transport pipe sections 34 to and from the magazine and the carriage assembly 28. The shuttle assembly 30 comprises a pair of shuttles 62 movably supported on the frame 12, and a drive assembly 64 for driving movement of shuttles. The shuttles 62 comprise grippers 66 used to hold the pipe sections 34 within a jaw insert 68. The grippers 66 are hydraulically actuated to open and close. The shuttles 62 also comprise a blocking surface 70 used to block pipe sections 34 within the magazine 26 as the shuttles move pipe to and from the carriage assembly 28 and the magazine 26. The carriage assembly 28 comprises a spindle 72 used to connect and disconnect pipe sections 34 to the drill string and a rotary drive 73 used to advance the pipe sections to the drill string. The shuttles 62 grab a pipe section 34 and transport the pipe section to the spindle 72 within the carriage assembly 28 for connection to the spindle 72. The shuttles 62 have a range of motion sufficient to allow them to move from the spindle 72 to the magazine column 38 furthest from the spindle. In an alternative embodiment the magazine 26 may move laterally relative to the shuttle 62 in order for the shuttles 62 to grab pipe sections 34 from each of the individual columns 38. Such a movable magazine is disclosed in U.S. Pat. No. 7,240,742 issued on Jul. 10, 2007 and U.S. Pat. No. 7,600,584 issued on Oct. 13, 2009, the contents of which are incorporated, herein by reference.

The shuttles 62 are positioned on the frame 12 generally parallel with each other. The shuttles 62 are advanced and retracted laterally and generally perpendicular to the spindle 72 in such a manner to shuttle pipe sections 34 between the drilling machine and the magazine 26. The extension and retraction of the shuttles 62 is powered by the drive assembly 64.

The drive assembly 64, illustrated in FIG. 4 comprises a hydraulic cylinder mounted to the frame 12 at a first end and a shuttle frame 74 at the second end. The shuttle frame 74 supports the shuttles 62 and a bar 76 connects the shuttles 62. The shuttle frame 74 allows the drive assembly 64 to actuate the shuttles in coordinated movement. Alternatively, the drive assembly 64 may comprise a rack and pinion, gear assembly mounted on the frame 12. A shaft may connect the respective rack and pinion gears so that operation of the hydraulic motor will drive coordinated operation of the shuttles.

Operation of the drive assembly 64 pivots the shuttles 62 to transport the pipe section 34 toward the spindle 72. The drive assembly 64 may also retract to either move the empty shuttles 62 back to a receiving area to receive another pipe section 34 or return the pipe section to the magazine 26. The shuttles 62 may move back to the magazine 26, with a pipe section 34 supported in the grippers 66, for loading the pipe section into the magazine. The shuttles 62 are moved to the appropriate column 38 and a pair of loader arms 78 are actuated to push the pipe section 34 into the magazine 26. Simultaneously, the pipe section biasing assembly 52 releases a sufficient amount of tension to allow for loading of the pipe section 34 into the magazine 26.

The carriage assembly 28 of FIG. 4 also comprises a make-up/break-out assembly 80 used to connect and disconnect pipe sections 34 to the uphole end of the drill string. The make-up/break-out assembly 80 comprises a set of pipe wrenches 82 and 84. The pipe wrenches 82 and 84 are used to grip the ends of adjacent pipe sections 34 during make-up and break-out operations. Wrench 82 functions to hold the drill, string while a new pipe section 34 is threaded onto the drill string by rotating the pipe section with the spindle 72. The make-up/break-out operation will be discussed in more detail hereinafter.

Turning now to FIG. 5, there is shown therein a sectional view of the magazine 26 of FIG. 2. As previously discussed, the pipe sections 34 are arranged in a series of columns 38 separated by dividers 44. While shown arranged in columns 38, one skilled in the art will appreciate that magazines having alternative pipe arrangements may be used in accordance with the present invention. Several such alternatives are disclosed in U.S. Pat. No. 6,543,551, the contents of which are incorporated herein by reference. As previously discussed, a stop tube 46 having a stop plate 48 is positioned within each column 38. Each stop plate 48 has a hook 86 formed to catch on the dividers, at the opposite end of the column 38 from the stop tube 46, when the last pipe section 34 of the column is removed. The interaction of the hook 86 with the divider 44 prevents the stop tube 46 from exiting from the open side 36 of the magazine 26.

FIG. 5 also shows the spool 52 positioned opposite the open side 36 of the magazine 26 and the band 50 extending from the spool along the side of the magazine, around the outer roller 54. The band 50 is run back up the side of the magazine 26 over the first stop tube 46 and down between the first and second columns 38. A set of rollers 90 may be positioned within the magazine for the band 50 to pass around at the bottom of each column 38. The band 50 is threaded over the second, third and fourth columns 38 and fastened to bracket 56. Positioning of the spool 52 on the magazine 26 as shown is not required. One skilled in the art will appreciate it may be mounted at different locations without departing from the spirit of their invention.

Figure 6:
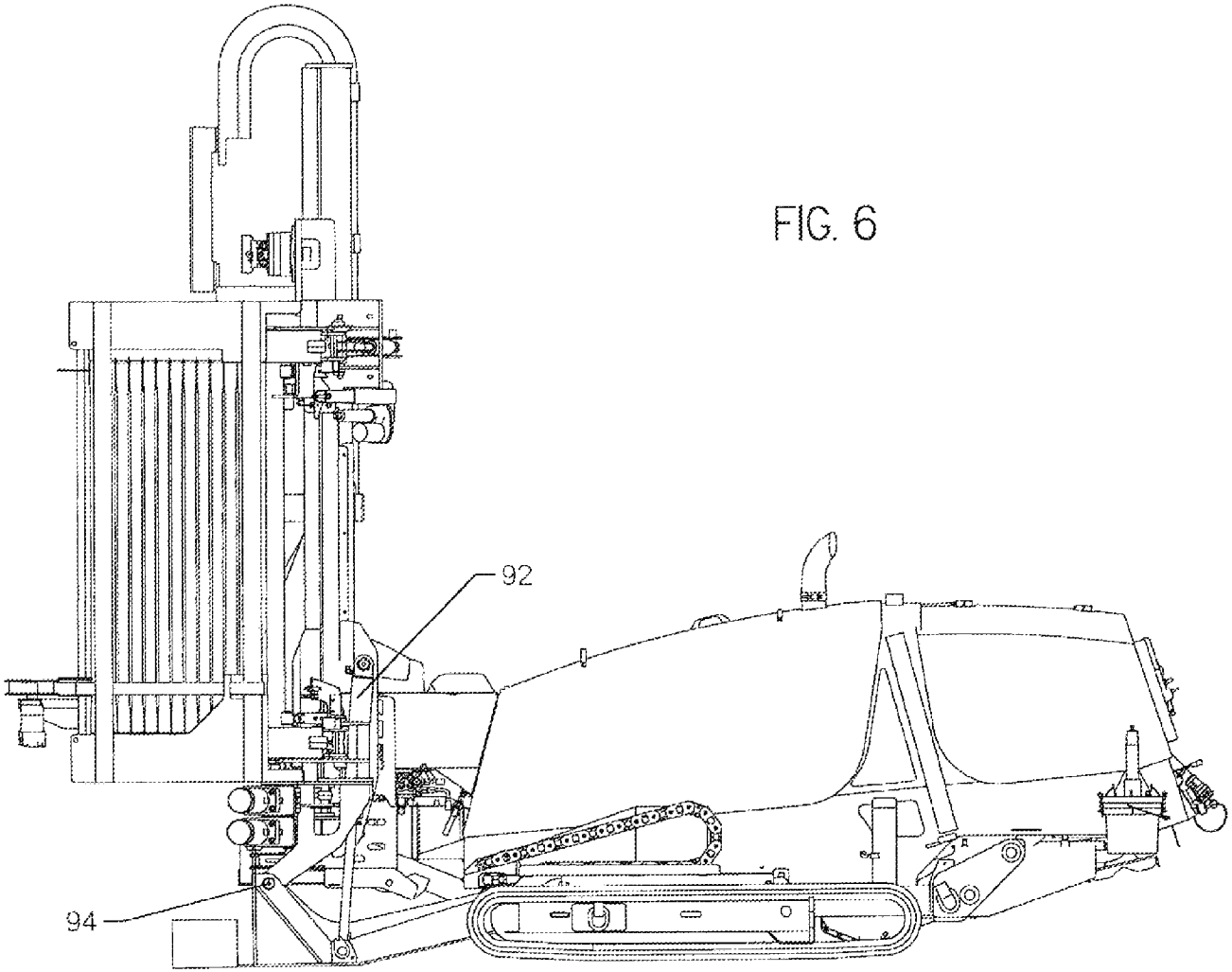
FIG. 6 is a side view of the drilling machine and the pipe handling system of the present invention pivoted from a generally horizontal position to a generally vertical position.

In operation, the drilling machine 10 is positioned at a desired location and earth anchors (not shown) are bored into the ground to hold the machine in place during the drilling operation. The pipe handling system 16 is pivoted upward as shown in FIG. 6 to a desired entry angle. Hydraulic cylinder 92 is used to pivot the pipe handling system 16 into position about pivot point 94.

Once the machine has been positioned and the pipe handling system 16 is pivoted to the second orientation, the machine may begin to drill a borehole. To receive a pipe section 34 from the magazine 26, the shuttle arms 62 of the shuttle assembly 30 are retracted to position the grippers 66 adjacent to the selected column 38 from which a pipe section 34 is to be received. Generally, pipe sections 34 are first retrieved from the column 38 proximate the drilling machine 10 until this column is empty. Thereafter, pipe sections 34 will be retrieved from the immediately adjacent column until it is also empty. Retrieval of pipe sections 34 will proceed in the same fashion until all columns 38 are empty of until the boring operation is complete.

After selecting the desired column 38, the shuttles 62 of the shuttle assembly 30 are retracted to position the gripper 66 adjacent to the selected column and the spool 52 is briefly activated to wind a predetermined length of band 50 thereon thus forcing the pipe section 34 out of the open side 36 of the magazine 26 and into the grippers 66. The grippers 66 hold the pipe section 34 to prevent it from slipping toward the ground as it is moved to the spindle 72. Drive assembly 64 is activated to advance the shuttles 62 toward the spindle 72. The blocking surface 70 engages the pipe section 34 at the open end 36 of each column to block the pipe sections 34 from falling out of the columns 38 as the shuttles 62 move back and forth from the spindle 72 to the selected column.

The shuttles 62 are advanced to the spindle 72 for connection of the pipe section 34 with the drill string of the drilling machine 10. To connect the pipe section 34 to the drill string, the grippers 66 hold the pipe section against rotation to allow the spindle 72 to be connected to the first end of the pipe section 34. A rod support 96 (FIG. 4) engages an end of the pipe section 34 to maintain axial alignment of the pipe section with the drill string. After connection, the grippers 66 are opened and the rotary drive 73 is advanced along the carriage assembly 28 to abut the end of the pipe section 34 with the end of the drill string. The uphold end of the drill string is held to prevent rotation by wrench 82 and passes through a rod guide 98. The rotary drive 73 is engaged and the pipe section 34 is threaded onto the end of the drill string. After threading the Wrench 82 is opened and boring operations may resume. This make-up process is repeated until the desired bore is complete.

To load pipe sections into the magazine 26 the drill string is retracted from the ground by moving the rotary drive 73 up the carriage assembly 28 so that the end of the pipe section 34 to be removed from the drill string is positioned within wrench 84 and the adjacent pipe section is gripped by wrench 82. The wrenches 82 and 84 are rotated relative to each other to initially break the connection. Wrench 84 is then opened and the rotary drive 73 is activated to complete unthreading of the pipe section 34 from the drill string.

The shuttles 62 are advanced to the spindle 72 with the grippers 66 open. Upon alignment of the grippers 66 with the pipe section 34, the grippers are closed to grasp the pipe section. The rotary drive 73 is activated again to disconnect the spindle 72 from the pipe section 34. The shuttles 62 are then retracted for return of the pipe section 34 to the magazine 26.

When returning pipe sections 34 to the magazine 26, the first column 38 that is not completely full of pipe sections is selected. The shuttles 62 are retracted to the magazine 26 and Adjacent the selected column 38. A hydraulic cylinder 100 is actuated to extend loader arms 78 to push the pipe section 34 into the column 38. Simultaneously with the actuation of cylinder 100, grippers 66 open and spool 52 momentarily releases tension on the band 50 to allow the pipe section 34 to move from the shuttles 62 and enter the column 38.

The rotary drive 73 is moved down the carriage assembly 28 to re-connect the spindle 72 to the drill string and the process is repeated until the magazine 26 is full or the drill string has been removed from the ground.

It will now be appreciated that the present invention permits automatic loading and unloading of pipe sections between a drilling machine and a magazine of the pipe handling assembly moveable between a horizontal position and a second orientation. The pipe sections are stored and transported in a second orientation and in ready alignment with the boring machine for immediate connection with the drill string. It further will be appreciated that the present invention actively positions the pipe sections within the magazine for movement of the pipe sections between the shuttles 62 and the magazine 26.

Although the present invention has been described with respect to preferred embodiment, various changes and modifications may be suggested to one skilled in the art, and it is intended that the present invention encompass such changes and modifications as fall within the scope of this disclosure.

What is claimed is:

1. A drilling machine, comprising:

a frame;

a pipe handling system, the pipe handling system comprising:

a magazine capable of moving between a horizontal position and a second orientation greater than 30 degrees relative to a horizontal plane, wherein the magazine stores a plurality of pipe sections and comprises an open side;

a carriage assembly for connecting the pipe sections to a drill string;

a shuttle assembly supported on the frame, wherein the shuttle assembly transports the pipe sections between the magazine and the carriage assembly; and a pipe section biasing assembly for biasing the pipe sections towards the open side, wherein the pipe section biasing assembly decreases a biasing force on the pipe sections within the magazine when the pipe sections are added to the magazine at the open side.

2. The drilling machine of claim 1 wherein the second orientation of the magazine may be any angle between 30 degrees and 90 degrees relative to the horizontal plane.

3. The drilling machine of claim 2 wherein the second orientation of the magazine is substantially 90 degrees relative to the horizontal plane.

4. The drilling machine of claim 1 wherein the pipe section biasing assembly comprises a band interwoven between a plurality of pipe receiving columns.

5. The drilling machine of claim 4 wherein the band extends from a metering device and is supported by a roller, the band being held in tension by a hydraulic motor operatively connected to the metering device.

6. The drilling machine of claim 1 further comprising a spindle to rotate the pipe sections to connect the pipe sections to the drill string.

7. The drilling machine of claim 1 wherein the magazine comprises a plurality of pipe receiving columns formed by a pair of opposing ends.

8. The drilling machine of claim 1 wherein the carriage assembly comprises a rod support for engaging an end of the pipe section to align the pipe section with the drill string.

9. The drilling machine of claim 1 wherein the shuttle assembly further comprises a pair of grippers to transport the pipe section between the magazine and the carriage assembly.

10. A pipe handling system for use with a drilling machine, the pipe handling system comprising:

a magazine moveable between a horizontal position and a second orientation greater than 30 degrees relative to a horizontal plane, wherein the magazine stores a plurality of pipe sections and comprises an open side;

a carriage assembly for connecting the pipe sections to a drill string;

a shuttle assembly for transporting the pipe sections between the magazine and the carriage assembly; and a pipe section biasing assembly for biasing the pipe sections within the magazine towards the shuttle assembly, wherein the pipe section biasing assembly decreases a biasing force on the pipe sections within the magazine as the pipe sections are added to the magazine; wherein the pipe section biasing assembly is on a side of the magazine opposite the open side.

11. The pipe handling system of claim 10 wherein the second orientation of the magazine may be any angle between 30 degrees and 90 degrees relative to the horizontal plane.

12. The pipe handling system of claim 11 wherein the second orientation of the magazine is substantially 90 degrees relative to the horizontal plane.

13. The pipe handling system of claim 10 wherein the pipe section biasing assembly comprises a band.

14. The pipe handling system of claim 13 wherein the band extends from a metering device and is supported by a roller, the band being held in tension by a hydraulic motor.

15. The pipe handling system of claim 10 wherein the pipe section biasing assembly comprises a band interwoven between each column.

16. The pipe handling system of claim 10 further comprising a spindle to rotate the pipe sections to connect the pipe sections to the drill string.

17. The pipe handling system of claim 10 wherein the magazine comprises a plurality of pipe receiving columns formed by a pair of opposing ends.

18. The pipe handling system of claim 10 wherein the carriage assembly comprises a rod support for engaging an end of the pipe section to align the pipe section with the drill string.

19. The pipe handling system of claim 10 wherein the shuttle assembly further comprises a pair of grippers to transport the pipe section to the carriage assembly.

20. A method for drilling into the ground, the method comprising the steps of:

positioning a drilling machine at a desired location;

pivoting a magazine containing a plurality of pipe sections from a substantially horizontal position to a second orientation greater than 30 degrees relative to a horizontal plane;

biasing the plurality of pipe sections towards a shuttle assembly using a pipe section biasing assembly that exerts a biasing tension;

grabbing a pipe section from an open side of the magazine using the shuttle assembly;

advancing the pipe section to a carriage assembly using the shuttle assembly;

connecting the pipe section to a drill string using the carriage assembly and advancing the drill string;

retracting the drill string;

disconnecting the pipe section from the drill string;

transporting the pipe section from the carriage assembly to the magazine;

decreasing the biasing tension to insert the pipe section into the magazine; and inserting the pipe section into the magazine.

21. The method of claim 20 wherein the second orientation of the magazine may be any angle between 30 degrees and 90 degrees relative to the horizontal plane.

22. The method of claim 21 wherein the second orientation of the magazine is substantially 90 degrees relative to the horizontal plane.

23. The method of claim 20 further comprising the step of threading the pipe section onto a spindle within the carriage assembly in preparation to connect the pipe section to the drill string.

24. The method of claim 20 further comprising the step of using a rod support to engage an end of the pipe section to maintain axial alignment of the pipe section with the drill string.

25. A method for removing a drill string from the ground, the method comprising the steps of:

disconnecting a pipe section of the drill string from the drill string using a carriage assembly;

transporting the pipe section from the carriage assembly to a magazine using a shuttle assembly;

decreasing a tension exerted by a pipe biasing assembly attached to the magazine in order to allow the pipe section to be inserted within an open column of the magazine; and using the shuttle assembly to insert the pipe section into the column within the magazine.

26. The method of claim 25 further comprising the step of unthreading the pipe section from the drill string using a spindle within the carriage assembly.

27. The method of claim 25 wherein the method is repeated until the entire drill string is removed from the ground.

* * * * *